United States Patent [19]

Marr et al.

[11] Patent Number: 4,969,959

[45] Date of Patent: Nov. 13, 1990

[54] METHODS FOR ENHANCING THE THERMAL QUENCHING OF A METAL SURFACE

[75] Inventors: Joseph M. Marr, Florence, Ala.; Barry L. Riddle, Chesterfield, Va.

[73] Assignee: Reynolds Metals Company, Richmond, Va.

[21] Appl. No.: 387,468

[22] Filed: Jul. 31, 1989

[51] Int. Cl.[5] ..... C21D 1/56; C21D 1/60

[52] U.S. Cl. ..... 148/20.6; 148/18; 148/28

[58] Field of Search ..... 148/18–20.6, 148/28

[56] References Cited

U.S. PATENT DOCUMENTS

| | | | |
|---|---|---|---|
| 3,310,489 | 3/1967 | Davis | 252/32.5 |
| 3,496,104 | 2/1970 | Shimada et al. | 252/32.5 |
| 3,645,897 | 2/1972 | Gower et al. | 252/34.7 |
| 3,729,417 | 4/1973 | Hashimoto et al. | 148/18 |
| 3,788,988 | 1/1974 | Dubourg | 252/32.5 |
| 3,966,619 | 6/1976 | Smith et al. | 252/32.5 |
| 4,268,404 | 5/1981 | Ahlgrim et al. | 252/25 |
| 4,303,540 | 12/1981 | Schuster | 252/49.3 |
| 4,384,965 | 5/1983 | Hellsten et al. | 252/32.5 |
| 4,521,321 | 6/1985 | Anderson et al. | 252/49.3 |
| 4,593,745 | 6/1986 | Yu et al. | 164/487 |
| 4,636,321 | 1/1987 | Kipp et al. | 252/49.3 |
| 4,654,155 | 3/1987 | Kipp et al. | 252/32.5 |
| 4,758,359 | 7/1988 | Kirk et al. | 252/32.5 |

FOREIGN PATENT DOCUMENTS

| | | | |
|---|---|---|---|
| 62-33785 | 2/1987 | Japan | 148/18 |
| 574460 | 9/1977 | U.S.S.R. | 252/32.5 |
| 1011677 | 4/1983 | U.S.S.R. | 252/32.5 |
| 1043488 | 9/1966 | United Kingdom | 252/32.5 |

*Primary Examiner*—Theodore Morris
*Assistant Examiner*—Margery Phipps
*Attorney, Agent, or Firm*—Alan T. McDonald

[57] ABSTRACT

A method for enhancing the thermal quenching of a metal surface comprises treating the metal surface with a complex phosphate acid ester. The metal surface is simultaneously or subsequently treated with a thermal quenching fluid. The method is particularly adapted for use in thermal quenching of aluminum and aluminum alloy surfaces. The complex phosphate acid ester has the formula:

15 Claims, 3 Drawing Sheets

METHODS FOR ENHANCING THE THERMAL QUENCHING OF A METAL SURFACE

FIELD OF THE INVENTION

The present invention relates to methods for enhancing the thermal quenching of a metal surface. More particularly, the present invention relates to methods for providing faster and/or more uniform thermal quenching of metal surfaces. The present methods are particularly adapted for use with aluminum and aluminum alloy metals.

BACKGROUND OF THE INVENTION

Complex phosphate acid esters and their use in industrial metalworking processes are known in the art. For example, the Kipp et al U.S. Pat. Nos. 4,636,321 and 4,654,155 respectively disclose water soluble and water-emulsifiable metalworking lubricants which contain, among other ingredients, a complex organic phosphate ester. The organic phosphate esters are disclosed as being extreme pressure additives in the lubricant compositions. Similarly, the Kirk et al U.S. Pat. No. 4,758,359 discloses metalworking lubricants consisting essentially of water and complex organic phosphate esters. The phosphate ester additives are disclosed as providing lubricating functions and protecting metal surfaces from damage by tools and the like Additional lubricant compositions for working metals and containing phosphate compounds are also known in the art. For example, the Davis U.S. Pat. No. 3,310,489 discloses lubricant compositions for use in metalworking operations, which compositions contain a corrosion inhibitor which is the reaction product of an amine and a phosphate ester. The Shimada et al U.S. Pat. No. 3,496,104 discloses a cold rolling lubricant composition for steel plates, which composition comprises at least one water soluble organic phosphate ester compound as the lubricating agent. Similarly, the Gower U.S. Pat. No. 3,645,897 discloses water based lubricant compositions which may include extreme pressure agents comprising amine salts of fatty acids and organic phosphate esters.

Additional lubricant compositions comprising phosphate esters and/or derivatives thereof are disclosed in the Dubourg U.S. Pat. No. 3,788,988, the Smith et al U.S. Pat. No. 3,966,619, the Hellsten et al U.S. Pat. No. 4,384,965, the Anderson et al U.S. Pat. No. 4,521,321, the British Patent No. 1,043,488 and the Soviet Reference No. 1,011,677. These various references disclose the inclusion of phosphate esters and/or derivatives thereof for use as emulsifiers, dispersants, solubilizers, extreme pressure additives and the like in metalworking lubricant compositions.

The Ahlgrim et al U.S. Pat. No. 4,268,404 and the Schuster U.S. Pat. No. 4,303,540 disclose compositions useful as lubricants and/or coolants in the metalworking industry. More specifically, Ahlgrim et al disclose compositions comprising a long chain ammonium polyphosphate as an effective additive in lubricants and coolants for metalworking while Schuster discloses a cooling and lubricating agent produced by the condensation reaction between an excess amino alcohol with boric acid and the addition of a carboxylic acid to the complex boron containing diamine formed in the reaction system.

The Yu et al U.S. Pat. No. 4,593,745 teaches the use of various agents such as ethylene glycol, halogenated hydrocarbons, and simple organic phosphate triesters alone and in combination with water as fire and explosion resistant quenching media in the casting of metals. It is apparent that the fire resistant phosphate triesters of Yu et al differ in chemical structure from the complex organic phosphate acid esters employed in the present invention.

In many metalworking processes, thermal quenching of metal surfaces is required. Fast and uniform thermal quenching of metal parts is desired in providing improved processing and/or products. Accordingly, a continuing need exists for providing improved thermal quenching processes wherein the quenching time is reduced and/or the resulting thermal quenching is provided in a more uniform manner.

SUMMARY OF THE INVENTION

Accordingly, it is an object of the present invention to provide a method for enhancing the thermal quenching of the surface of a metal part. It is an additional object of the invention to provide a method for enhancing the thermal quenching of a metal surface wherein the thermal quenching is effected in a faster and/or more uniform manner. It is a further object of the invention to provide a method for enhancing the thermal quenching of a metal surface wherein a thermal quenching fluid is employed.

These and additional objects are provided by the present invention which relates to methods for enhancing the thermal quenching of a metal surface. The methods comprise treating the metal surface with a complex phosphate acid ester. The metal surface is simultaneously or subsequently treated with a thermal quenching fluid to effect quenching. The thermal quenching is effected in a fast and/or uniform manner. The methods according to the present invention are particularly adapted for use in the thermal quenching of aluminum and aluminum alloy surfaces of metal parts. The thermal quenching methods according to the present invention may be employed in various metal processing applications, for example hot rolling, casting, extrusion and heat treating, among others.

These and additional objects and advantages will be more fully understood in view of the following detailed description.

DETAILED DESCRIPTION

Figure 1:
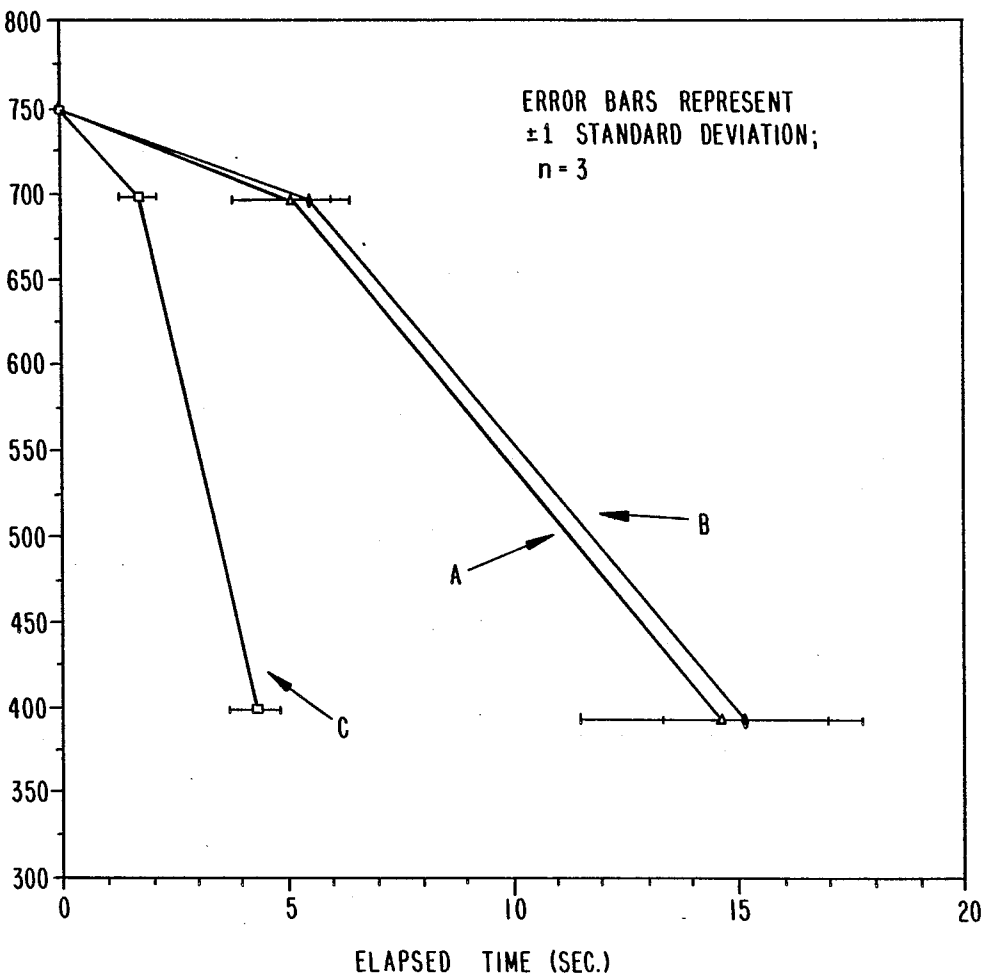
FIGS. 1-3 set forth thermal quench data collected from experimental runs of thermal quench methods according to the present invention and comparative thermal quench methods of the prior art as set forth in further detail in the Examples.

The present invention relates to methods for enhancing the thermal quenching of a metal surface. The methods are particularly adapted for use in the thermal quenching of aluminum and aluminum alloy surfaces but may also be employed in the thermal quenching of various other types of metal parts.

Generally, the methods according to the present invention comprise treating the metal surface with a complex phosphate acid ester and simultaneously or subsequently treating the metal surface with a thermal quenching fluid. It is preferred that the complex phosphate acid ester is in the form of an aqueous solution, a microemulsion or a macroemulsion when contacted with the metal surface. It is believed that the complex organic phosphate acid esters produce an adsorbed residue on the metal surface which provides a significant increase in the thermal transfer from the metal surface to a thermal quenching fluid. The enhancement in thermal quenching provided by the present method differs from friction reducing effects of extreme pressure agents comprising such phosphate esters which adsorb or react to produce a low shear strength film. Such a low shear strength film reduces adhesion and the generation of heating during the rubbing of two sliding surfaces. However, the enhanced thermal quenching provided by the methods of the present invention occurs in environments where rubbing of metal parts is not necessarily encountered. For example, the present method is suitable for providing enhanced thermal quenching when a complex phosphate acid ester-treated hot metal specimen is immersed in a thermal quenching fluid. According to this method, the metal specimen exhibits increased thermal quenching as compared to similar specimens which are not pretreated with the complex phosphate acid ester. Since no metal-to-metal rubbing occurs in the thermal quenching methods of the invention, the significant improvements in thermal quenching are not a result of the extreme pressure properties of the complex organic phosphate acid esters known in the art.

When the metal surface is treated with a complex organic phosphate acid ester according to the present invention and the phosphate ester is in the form of an aqueous solution, microemulsion or macroemulsion, it is preferred that the complex organic phosphate acid ester is included in the aqueous solution, microemulsion, macroemulsion in an amount in the range of about 0.01 to about 1% by weight. This concentration range is significantly less than that typically employed with known quenchants, for example polyalkylene glycol polymers, typically used in concentrations of about 8 to about 10% by weight. Thus, the complex organic phosphate acid esters employed as thermal quenching enhancers according to the present methods may be used in significantly lower concentrations as compared with prior art quenchants.

Various complex organic phosphate acid esters are known in the art and are suitable for use in the method of the present invention. In a preferred embodiment, the complex organic phosphate acid ester is of the formula

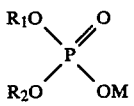

wherein M is selected from the group consisting of hydrogen, metal cations, alkylamine cations containing 2 to 20 carbon atoms, and alkanolamine cations containing 2 to 8 carbon atoms; $R_1$ is a polyoxyalkylated alcohol wherein the alcohol portion is derived from a member selected from the group consisting of saturated and unsaturated alkyl radicals having 1 to about 20 carbon atoms, aryl radicals and alkylaryl radicals wherein the alkyl substituent comprises from 1 to about 20 carbon atoms and is saturated or unsaturated and wherein the polyoxyalkylated portion of $R_1$ is derived from a member selected from the group consisting of a polymerizable alkylene oxide, a polyhydric alkanol having about 2 to about 10 carbon atoms, or a mixture thereof; and $R_2$ is selected from the group consisting of the substituents from which M is selected and the substituents from which $R_1$ is selected. In further preferred embodiments, M is selected from the group consisting of hydrogen, metal cations, ethylamine, diethylamine, octylamine, octadecylamine, monoethylamine, diethanolamine, triethanolamine and aminomethyl propanol, the polyoxyalkylated portion of $R_1$ is derived from a member selected from the group consisting of ethylene oxide, propylene oxide and butylene oxide, and the polyoxyalkylated portion of Rl contains up to about 50 monomeric units. In an especially preferred embodiment of the present invention, M is the cation of triethanolamine, $R_1$ and $R_2$ are polyethoxylated four to twelve carbon normal alcohols, and the weight percent of the ethoxylation is from about 40 to about 80 percent of the molecular weight of the complex organic phosphate acid ester. Complex organic phosphate esters of the type suitable for use in the present invention are commercially available as "Maphos" from Mazer Chemicals, Inc. of Gurnee, Ill., "Cyclophos" from Cyclo Chemicals Corporation of Miami, Fla., "Gafac" and "Antara" from GAF Corporation of New York, N.Y. and "Vanlube" from R.T. Vanderbilt Company, Inc. of Norwalk, Conn.

In practicing the method of the present invention, the metal surface may be treated with the complex organic phosphate acid ester by coating a solution, microemulsion or macroemulsion containing the phosphate ester on the metal surface or, alternatively, by immersing the metal surface in a solution, microemulsion or macroemulsion of the phosphate ester. As noted above, simultaneous with or subsequent to the phosphate ester treatment, the metal surface is treated with a thermal quenching fluid. If the treatment with the thermal quenching fluid is simultaneous with the phosphate ester treatment, it is preferred that the complex phosphate acid ester is contained in the thermal quenching fluid. The metal surface may merely be immersed in the thermal quenching fluid containing the phosphate acid ester. In the embodiment of the present invention wherein the phosphate ester treated metal surface is subsequently treated with a thermal quenching fluid, pretreatment with the phosphate ester provides similarly improved heat transfer rates when the metal surface is immersed in a quenching fluid.

In a further embodiment of the invention, these previously discussed embodiments can be combined wherein the metal surface is first immersed in a thermal quenching fluid containing a phosphate ester and then is immersed in a second thermal quenching fluid which does not contain a phosphate acid ester. The present method may be practiced in various metal processing applications including hot rolling, casting, extrusion, heat treating and the like. In addition to the enhanced thermal quenching which results from the present method, the treated metal surfaces in applications in which metal to metal rubbing occurs also will exhibit a reduction in frictional heat generation owing to the extreme pressure properties of the complex organic phosphate acid esters. Additionally, the treated metal surfaces will exhibit corrosion resistance in various environments.

Although the present inventors have not positively identified the mechanism of heat transfer which results in the enhanced thermal quenching according to the present invention, it is believed that a more complex chemical-physical reaction occurs than simple "wetting" of the metal surface by the phosphate acid ester compounds. It is believed that the complex organic phosphate acid esters, when applied to the metal surfaces, produce an adsorbed residue and/or a reaction product which serves to enhance the thermal quenching of the metal surface. However, the present methods are not limited by this belief.

The method according to the present invention is further demonstrated by the following Examples. EXAMPLE 1

In this Example, a 2024 aluminum alloy test probe was acid etched to provide an equivalent surface prior to each thermal quenching experiment. In each experiment, the probe was heated to 750° F. and was immersed in one of three hot rolling oil-in-water emulsion lubricants, designated A, B and C. Lubricant A (3% by weight concentration) did not contain a complex organic phosphate acid ester. Lubricant B (6% by weight concentration) was different in composition from Lubricant A, but also did not contain a complex organic phosphate acid ester. Lubricant C (3% by weight concentration) was compositionally identical to Lubricant A except that Lubricant C contained 0.3% by weight of a complex organic phosphate acid ester (equivalent to 0.02% by weight phosphorus). Thus, Lubricant C, when used to thermally quench the test probe, provides simultaneous treatment of the test probe with the complex organic phosphate acid ester according to a preferred embodiment of the present invention. Prior to immersion of the test probe in the respective hot rolling lubricants, each probe exhibited an initial temperature of 750° F. The temperature of the probe was monitored until it was reduced to 400° F. as a function of elapsed time. The temperature profiles of the probe during exposure to Lubricants A, B and C are set forth in FIG. 1 by curves A, B and C, respectively. As is evident from FIG. 1, the hot rolling lubricant containing the complex organic phosphate acid ester (Lubricant C) exhibited significantly faster thermal quenching as compared with the conventional lubricants (Lubricants A and B), which did not contain the phosphate ester.

EXAMPLE 2

Figure 2:
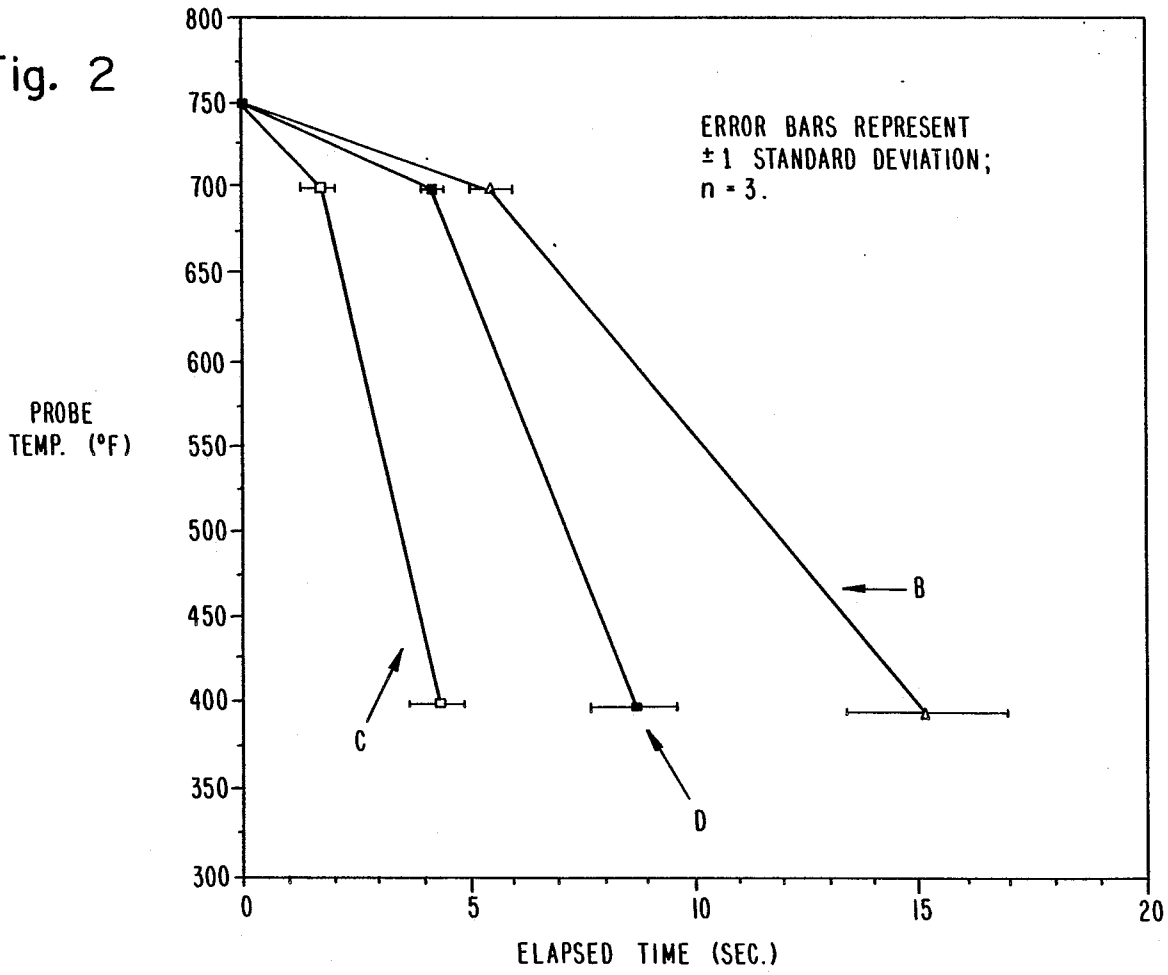

In this Example, the 2024 aluminum test probe was acid etched to provide an equivalent surface prior to each thermal quenching experiment. The test probe was heated to 750° F., immersed in Lubricant C of Experiment 1, and quenched to 400° F., thereby pretreating the probe surface with complex organic phosphate acid ester. Without acid etching to restore a fresh surface on the test probe, the probe was reheated to 750°F., immersed in Lubricant B of Example 1, and quenched to 400° F., producing cooling curve D of FIG. 2. Cooling curves B and C of FIG. 1 are repeated in FIG. 2 for reference. As is evident from FIG. 2, complex organic phosphate acid ester pretreatment and subsequent quenching (Curve D) yielded faster cooling than simple quenching with the same lubricant (Curve B) alone. A preferred embodiment of the present invention, complex organic phosphate acid ester pretreatment and subsequent quenching (Curve D) provided slower cooling than the more preferred embodiment of the present invention in which the metal is simultaneously exposed to the complex organic phosphate acid ester and the quenching fluid (Curve C).

EXAMPLE 3

Figure 3:
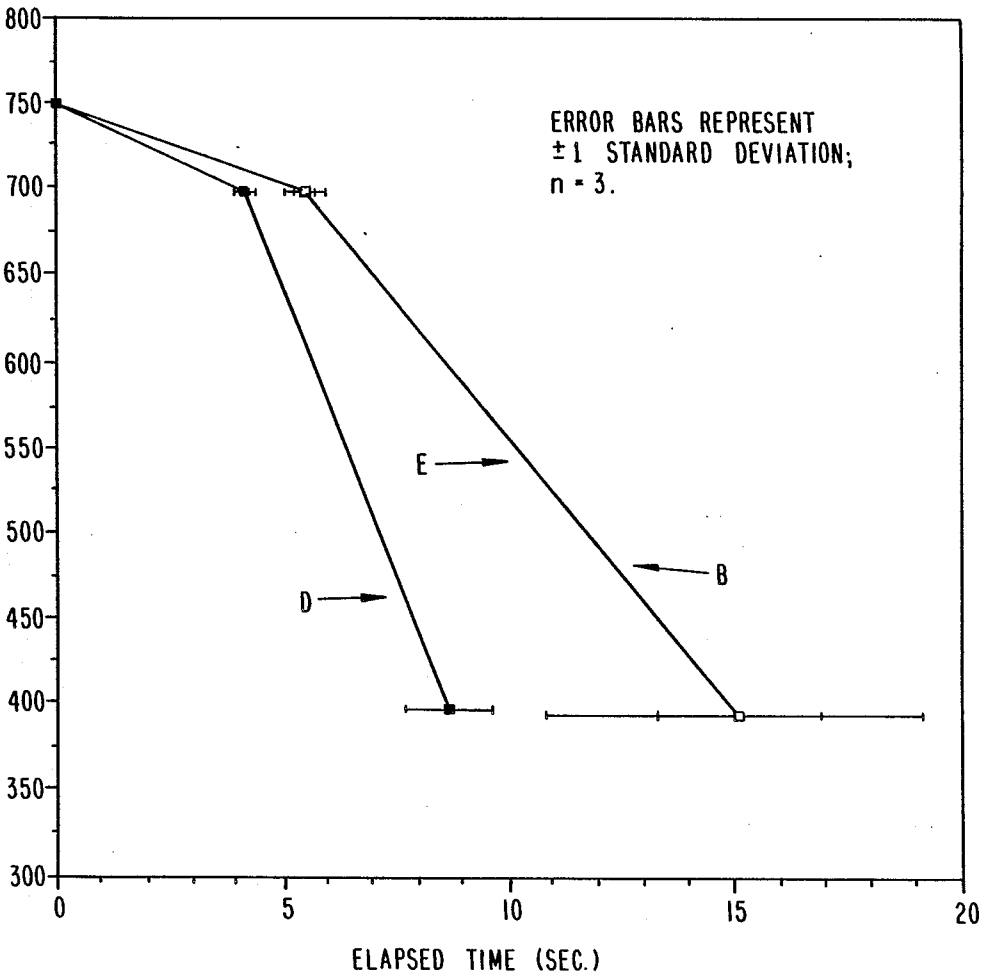

In this Example, the 2024 aluminum test probe was acid etched to provide an equivalent surface prior to each thermal quenching experiment. The test probe was heated to 750° F., immersed in Lubricant A of Experiment 1, and quenched to 400° F., thereby pretreating the probe surface with a lubricant which did not contain a complex organic phosphate acid ester. Without acid etching to restore a fresh surface on the test probe, the probe was reheated to 750° F., immersed in Lubricant B of Example 1, and quenched to 400° F., producing cooling curve E of FIG. 3. For purposes of comparison, temperature profile curves B and D from FIGS. 1 and 2, respectively, are also included in FIG. 3. As is evident from FIG. 3, the significantly faster quenching exhibited in curve D described in Example 2 was not exhibited in curve E. Rather, the thermal quenching in curve E was comparable to that of quenching curve B.

EXAMPLE 4

In this Example, respective 2024 aluminum alloy test probes were quenched in Lubricants A and C described in Example 1. The quenched probes were submitted for surface analysis by X-ray photoelectron spectroscopy. Of specific interest was the measurement of phosphorus on the probe surface. One $\frac{3}{4}'' \times \frac{1}{2}''$ sample from each probe was analyzed in the as-received condition, after one minute of argon sputter cleaning, and after five minutes of argon sputter cleaning. The atomic concentration results are set forth in the following Table.

TABLE

ATOMIC CONCENTRATION OF ELEMENTS AT THE SURFACE OF QUENCH TEST PROBES QUENCHED IN THE REYKOOL COOLANT WITH AND WITHOUT THE PHOSPHATE ESTER ADDITIVE

| | As Received | | After 1 Min. Sputter | | After 5 Min. Sputter | |
|---|---|---|---|---|---|---|
| Element | With P Ester | Without P Ester | With P Ester | Without P Ester | With P Ester | Without P Ester |
| C | 56.99 | 73.81 | 28.76 | 82.61 | 15.42 | 73.41 |
| O | 32.09 | 20.44 | 41.91 | 10.44 | 48.62 | 14.25 |
| Al | 1.61 | 1.23 | 5.77 | 2.52 | 14.45 | 6.11 |
| Mg | 1.32 | 0.54 | 3.58 | 1.05 | 4.46 | 2.14 |
| Si | 1.04 | 2.61 | — | 1.15 | — | 0.51 |
| Ca | 2.01 | 0.26 | 4.76 | 0.98 | 5.21 | 1.49 |
| Cr | 1.16 | 0.30 | 4.93 | 0.34 | 5.93 | 0.73 |
| P | 3.78 | 0.51 | 10.30 | 0.74 | 5.93 | 1.06 |
| S | — | 0.10 | — | — | — | 0.16 |

The sample probe quenched with the fluid containing the phosphate ester (Lubricant C) exhibited 3.8 atomic percent phosphorus within the outer 30 Angstroms of the surface and 10.30 atomic percent phosphorus in approximately the same volume of surface after a one minute sputter cleaning. On the other hand, the sample quenched with the fluid which did not contain the phosphate ester (Lubricant A) exhibited 0.50 atomic percent phosphorus before sputter cleaning and 0.74 atomic percent phosphorus after one minute of sputter cleaning. Additionally, the probe which was quenched with the fluid containing the phosphate ester exhibited significantly less hydrocarbon and significantly more oxygen, magnesium, calcium and chromium as compared with the probe quenched with the fluid not containing the phosphate ester.

The preceding Examples are set forth to illustrate specific embodiments of the invention and are not intended to limit the scope of the methods of the present invention. Additional embodiments and advantages within the scope of the claimed invention will be apparent to one of ordinary skill in the art.

We claim:

1. A method for increasing the rated thermal quenching of a metal surface from an elevated temperature to a second temperature comprising treating the metal surface with an aqueous solution, a microemulsion of a macroemulsion containing from about 0.01 to about 1% by weight of a complex organic phosphate acid ester, and contacting the treated metal surface with a thermal quenching fluid, said complex organic phosphate acid ester having the formula

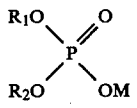

wherein M is selected from the group consisting of hydrogen, metal cations, alkylamine cations containing 2 to 20 carbon atoms, and alkanolamine cations containing 2 to 8 carbon atoms; $R_1$ is a polyoxyalkylated alcohol wherein the alcohol portion is derived from a member selected from the group consisting of saturated and unsaturated alkyl radicals having 1 to about 20 carbon atoms, aryl radicals, and alkylaryl radicals wherein the alkyl substituent comprises from 1 to about 20 carbon atoms and is saturated or unsaturated and wherein the polyoxyalkylated portion of $R_1$ is derived from a member selected from the group consisting of a polymerizable alkylene oxide, a polyhydric alkanol having about 2 to about 10 carbon atoms or a mixture thereof; and $R_2$ is selected from the group consisting of the substituents from which M is selected and the substituents from which $R_1$ is selected.

2. A method as defined in claim 1, wherein the metal surface comprises aluminum.

3. A method as defined by claim 1, wherein the metal surface comprises an aluminum alloy.

4. A method as defined by claim 1 wherein M is selected from the group consisting of hydrogen, metal cations, ethyl amine, diethyl amine, oxtyl amine, octadecyl amine, monoethanolamine, diethanolamine, triethanolamine and aminomethyl propanol.

5. A method as defined by claim 1, wherein the treated metal surface is sprayed with the thermal quenching fluid.

6. A method as defined in claim 1 wherein the poloxyalkylated portion of $R_1$ is derived from a member selected from the group consisting of ethylene oxide, propylene oxide and butylene oxide.

7. A method as defined by claim 6, wherein the polyoxyalkylated portion of $R_1$ contains up to about 50 monomeric units.

8. A method as defined by claim 7, wherein M is the cation of triethanolamine, $R_1$ and $R_2$ are polyethoxylated four to twelve carbon normal alcohols, and the weight percent of the ethoxylation is from about 40 to about 80 percent of the molecular weight of the complex organic phosphate acid ester.

9. A method as defined by claim 1, wherein the treated metal surface is immersed in the thermal quenching fluid.

10. A method as defined by claim 9, wherein the metal surface comprises an aluminum alloy.

11. A method as defined by claim 9, wherein the polyoxyalkylated portion of $R_1$ up to about 50 monomeric units.

12. A method as defined by claim 9, wherein the metal surface comprises aluminum.

13. A method as defined by claim 12, wherein M is selected from the group consisting of hydrogen, metal cations, ethyl amine, diethyl amine, octyl amine, octadecyl amine, monoethanolamine, diethanolamine, triethanolamine and aminomethyl propanol.

14. A method as defined by claim 12, wherein the propylalkylated portion of $R_1$ is derived from a member selected from the group consisting of ethylene oxide, propylene oxide and butylene oxide.

15. A method for increasing the rate of thermal quenching of a metal surface from an elevated temperature to a second temperature comprising treating the metal surface with a thermal quenching fluid which includes an aqueous solution, a microemulsion or a macroemulsion containing from about 0.01 to about 1% by weight of a complex organic phosphate acid ester having the formula

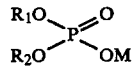

wherein M is selected from the group consisting of hydrogen, metal cations, alkylamine cations containing 2 to 20 carbon atoms, and alkanolamine cations containing 2 to 8 carbon atoms; $R_1$ is a polyoxyalkylated alcohol wherein the alcohol portion is derived from a member selected from the group consisting of saturated and unsaturated alkyl radicals having 1 to about 20 carbon atoms, aryl radicals, and alkylaryl radicals wherein the alkyl substituent comprises from 1 to about 20 carbon atoms and is saturated or unsaturated and wherein the polyoxyalkylated portion of $R_1$ is derived from a member selected from the group consisting of a polymerizable alkylene oxide, a polyhydric alkanol having about 2 to about 10 carbon atoms or a mixture thereof; and $R_2$ is selected from the group consisting of the substituents from which M is selected and the substituents from which $R_1$ is selected.

* * * * *